US009921536B2

(12) United States Patent
Kawakami et al.

(10) Patent No.: US 9,921,536 B2
(45) Date of Patent: Mar. 20, 2018

(54) ELECTROPHOTOGRAPHIC PHOTOSENSITIVE DRUM UNIT, CARTRIDGE, AND FLANGE MEMBER

(71) Applicant: CANON KABUSHIKI KAISHA, Tokyo (JP)

(72) Inventors: Takuya Kawakami, Mishima (JP); Yohei Kusano, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/288,989

(22) Filed: Oct. 7, 2016

(65) Prior Publication Data

US 2017/0108816 A1 Apr. 20, 2017

(30) Foreign Application Priority Data

Oct. 14, 2015 (JP) ..... 2015-203145

(51) Int. Cl.
*G03G 15/00* (2006.01)
*G03G 21/16* (2006.01)

(52) U.S. Cl.
CPC ..... *G03G 15/751* (2013.01); *G03G 15/757* (2013.01); *G03G 21/1647* (2013.01); *G03G 21/1671* (2013.01); *G03G 2221/1606* (2013.01); *G03G 2221/1657* (2013.01)

(58) Field of Classification Search
CPC ..... G03G 15/751; G03G 15/757; G03G 21/1647; G03G 21/1671; G03G 2221/1657; G03G 2221/1606
See application file for complete search history.

(56) References Cited

U.S. PATENT DOCUMENTS 6,473,580 B1 * 10/2002 Inomata ..... F16D 1/112 399/111
2002/0172531 A1 * 11/2002 Harada ..... G03G 15/757 399/167

FOREIGN PATENT DOCUMENTS

| | | | |
|---|---|---|---|
| JP | 2007199438 | A | 8/2007 |
| JP | 2014240991 | A | 12/2014 |
| JP | 2015079243 | A | 4/2015 |
| JP | 2016028261 | A | 2/2016 |
| JP | 2016040625 | A | 3/2016 |
| WO | 2014157113 | A1 | 10/2014 |
| WO | 2013/140467 | A1 | 8/2015 |

* cited by examiner

*Primary Examiner* — Hoang Ngo
(74) *Attorney, Agent, or Firm* — Canon U.S.A., Inc. IP Division

(57) ABSTRACT

A flange member includes a first cylindrical portion, a second cylindrical portion disposed inside the first cylindrical portion coaxially with the first cylindrical portion, an inwardly protruding portion protruding from an inner circumference of the second cylindrical portion, a first wall extending in the central axis direction and connecting the first cylindrical portion and the second cylindrical portion together and is in contact with a shaft member between the first wall and the second wall to receive a driving force, a second wall opposed to the first wall, and a connecting portion connecting the first cylindrical portion and the second cylindrical portion and connecting the first wall and the second wall. A groove is provided inside the first cylindrical portion and outside the second cylindrical portion. The connecting portion is disposed adjacent to the inwardly protruding portion with respect to the shaft member in the central axis direction.

20 Claims, 12 Drawing Sheets

ELECTROPHOTOGRAPHIC PHOTOSENSITIVE DRUM UNIT, CARTRIDGE, AND FLANGE MEMBER

BACKGROUND OF THE INVENTION

Field of the Invention

The present disclosure relates to an electrophotographic photosensitive drum unit of a cartridge (a process cartridge) for use in an electrophotographic image forming apparatus and relates to a flange member for use in the electrophotographic photosensitive drum unit.

The electrophotographic image forming apparatus is an apparatus for use in forming an image on a recording medium using an electrophotographic image forming method. Examples of the electrophotographic image forming apparatus include electrophotographic copiers, electrophotographic printers (for example, LED printers and laser beam printers), fax machines, and word processors.

The process cartridge is a combination of an electrophotographic photosensitive drum and a processing unit for the electrophotographic photosensitive drum and is detachably mounted in the electrophotographic image forming apparatus main body. One example is a combination of an electrophotographic photosensitive drum and at least one of a developing unit, a charging unit, and a cleaning unit (the processing unit).

Description of the Related Art

In the electrophotographic image forming apparatus (hereinafter simply referred to as "image forming apparatus"), an electrophotographic photosensitive member serving as an image bearing member, which is generally drum-shaped, is uniformly charged with electricity. Next, the charged electrophotographic photosensitive drum is selectively exposed to light to form an electrostatic latent image (an electrostatic image) on the electrophotographic photosensitive drum. Then, the electrostatic latent image formed on the electrophotographic photosensitive drum is developed into a toner image with toner serving as a developer. The toner image formed on the electrophotographic photosensitive drum is transferred to a recording medium, such as a recording sheet or a plastic sheet, the toner image transferred onto the recording medium is subjected to heat or pressure so that the toner image is fixed to the recording medium, and thus the image is printed.

Such image forming apparatuses generally need replenishing of toner and maintenance of the processing units. To facilitate the replenishing of toner and the maintenance, a process cartridge detachably mounted in an image forming apparatus main body is in practical use. The process cartridge contains, in a frame, the electrophotographic photosensitive drum, the charging unit, the developing unit, the cleaning unit, and so on.

This process cartridge system changes the operability because a user can perform maintenance by himself/herself, thus providing a usable image forming apparatus. This process cartridge system is widely used in image forming apparatuses.

The process cartridge employs a flange member integrally connected to the electrophotographic photosensitive drum. Japanese Patent Laid-Open No. 2015-079243 discloses portions (transmitted portions 87*g*) of the flange member subjected to a driving force transmitted from an image forming apparatus main body to a coupling member. This flange member works to transmit the driving force to the electrophotographic photosensitive drum.

If the flange member has low rigidity, the portion of the flange member subjected to the driving force from the coupling member rotates in a deformed state, and the amount of deformation can change with a change in load. The change in the amount of deformation of the flange member can change the rotational speed of the electrophotographic photosensitive drum unit, which can decrease the quality of an image formed by the electrophotographic image forming apparatus.

SUMMARY OF THE INVENTION

The present disclosure enhances the rigidity of a flange member.

An electrophotographic photosensitive drum unit according to a first aspect of the present disclosure includes an electrophotographic photosensitive drum, a coupling member that rotates when subjected to a driving force, a shaft member that rotates when subjected to the driving force from the coupling member, and a flange member secured to the electrophotographic photosensitive drum and rotates when subjected to the driving force from the shaft member. The flange member includes a first cylindrical portion, a second cylindrical portion, an inwardly protruding portion, a first wall, a second wall, and a connecting portion. The second cylindrical portion is disposed inside the first cylindrical portion in such a manner that a central axis is coaxial with the first cylindrical portion. The inwardly protruding portion protrudes from an inner circumference of the second cylindrical portion and restricts a position of the coupling member in a central axis direction of the first cylindrical portion. The first wall extends in the central axis direction and connects the first cylindrical portion and the second cylindrical portion together. The first wall is in contact with the shaft member to receive the driving force. The second wall extends in the central axis and connects the first cylindrical portion and the second cylindrical portion together. The second wall is opposed to the first wall. The connecting portion connects the first cylindrical portion and the second cylindrical portion together and connects the first wall and the second wall together. A groove is provided inside the first cylindrical portion and outside the second cylindrical portion. The coupling member is held in the second cylindrical portion so as to be capable of tilting. The shaft member is disposed between the first wall and the second wall. The connecting portion is disposed adjacent to the inwardly protruding portion with respect to the shaft member in the central axis direction.

According to a second aspect of the present disclosure, a cartridge detachably mounted in an image forming apparatus main body is provided. The cartridge includes an electrophotographic photosensitive drum unit and a drum supporting member. The electrophotographic photosensitive drum unit includes an electrophotographic photosensitive drum, a coupling member configured to rotate when subjected to a driving force, a shaft member configured to rotate when subjected to the driving force from the coupling member, and a flange member secured to the electrophotographic photosensitive drum. The flange member is configured to rotate when subjected to the driving force from the shaft member. The drum supporting member rotatably supports the electrophotographic photosensitive drum unit. The flange member includes a first cylindrical portion, a second cylindrical portion, an inwardly protruding portion, a first wall, a second wall, and a connecting portion. The first cylindrical portion is rotatably supported by the drum supporting member. The second cylindrical portion is disposed inside the first cylindrical portion in such a manner that a central axis is coaxial with the first cylindrical portion. The inwardly protruding portion protrudes inwards from an inner circumference of the second cylindrical portion and restricts a position of the coupling member in a central axis direction of the first cylindrical portion. The first wall extends in the central axis direction, connects the first cylindrical portion and the second cylindrical portion together, and is in contact with the shaft member to receive the driving force. The second wall extends in the central axis, connects the first cylindrical portion and the second cylindrical portion together, and is opposed to the first wall. The connecting portion connects the first cylindrical portion and the second cylindrical portion together and connects the first wall and the second wall together. A groove is provided inside the first cylindrical portion and outside the second cylindrical portion. The coupling member is held in the second cylindrical portion so as to be capable of tilting. The shaft member is disposed between the first wall and the second wall. The connecting portion is disposed adjacent to the inwardly protruding portion with respect to the shaft member in the central axis direction.

According to a third aspect of the present disclosure, a flange member secured to an electrophotographic photosensitive drum and configured to rotate when subjected to a driving force from a shaft member that rotates when subjected to the driving force from a coupling member subjected to the driving force is provided. The flange member includes a first cylindrical portion, a second cylindrical portion, an inwardly protruding portion, a first wall, a second wall, and a connecting portion. The second cylindrical portion is disposed inside the first cylindrical portion in such a manner that a central axis is coaxial with the first cylindrical portion. The inwardly protruding portion protrudes inwards from an inner circumference of the second cylindrical portion. The first wall extends in the central axis direction, connects the first cylindrical portion and the second cylindrical portion together, and is in contact with the shaft member to receive the driving force. The second wall extends in the central axis, connects the first cylindrical portion and the second cylindrical portion together, and is opposed to the first wall. The connecting portion connects the first cylindrical portion and the second cylindrical portion together and connects the first wall and the second wall together. A groove is provided inside the first cylindrical portion and outside the second cylindrical portion. A hollow is provided inside the second cylindrical portion. A recessed portion recessed outwards from an inner circumferential surface of the second cylindrical portion is formed by the first wall, the second wall, and the connecting portion. The connecting portion is disposed adjacent to the inwardly protruding portion with respect to the recessed portion in the central axis direction.

Further features of the present invention will become apparent from the following description of exemplary embodiments with reference to the attached drawings.

DESCRIPTION OF THE EMBODIMENTS

Embodiments of the present disclosure will be described in detail hereinbelow with reference to the drawings. The direction of the axis of rotation of an electrophotographic photosensitive drum (hereinafter referred to as "photosensitive drum") 62 is a longitudinal direction. In the longitudinal direction, the side at which the electrophotographic photosensitive drum 62 is subjected to a driving force from the image forming apparatus main body is a driven side and the other side is a non-driven side.

Figure 2:
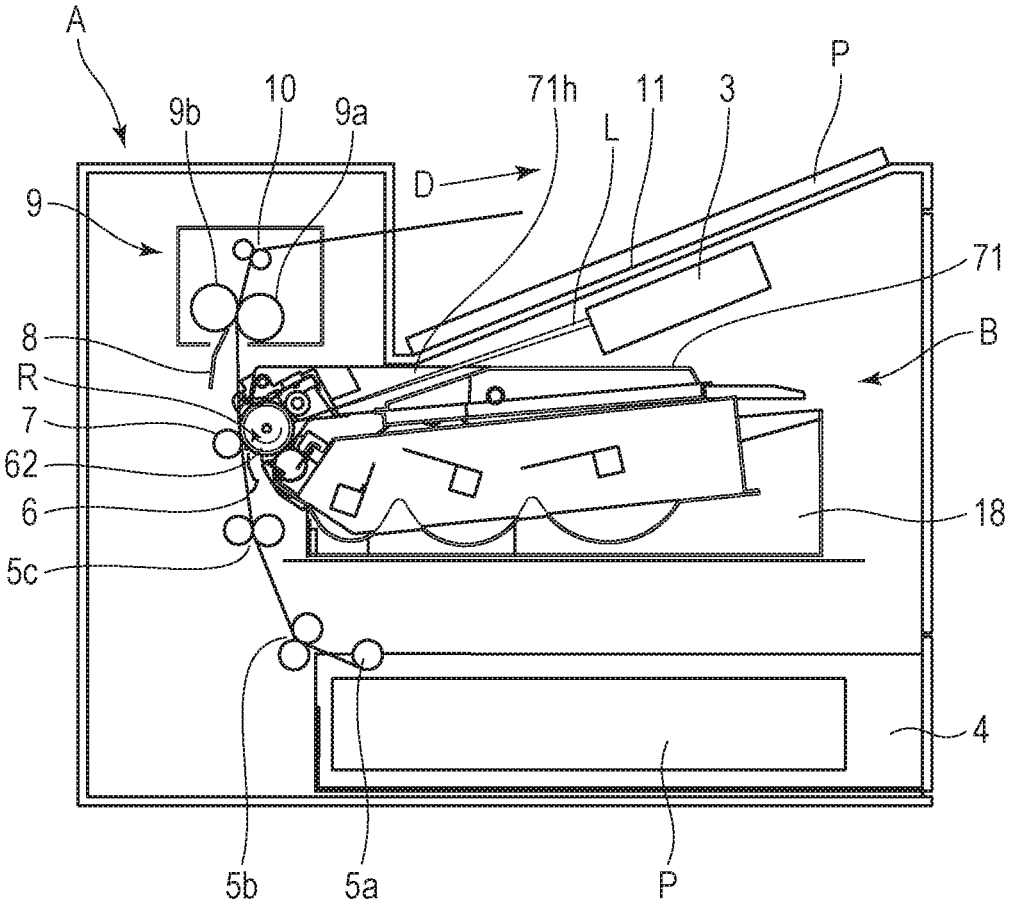
FIG. 2 is a cross-sectional view of an image forming apparatus main body and a process cartridge of an electrophotographic image forming apparatus according to an embodiment of the present disclosure.
Figure 3:
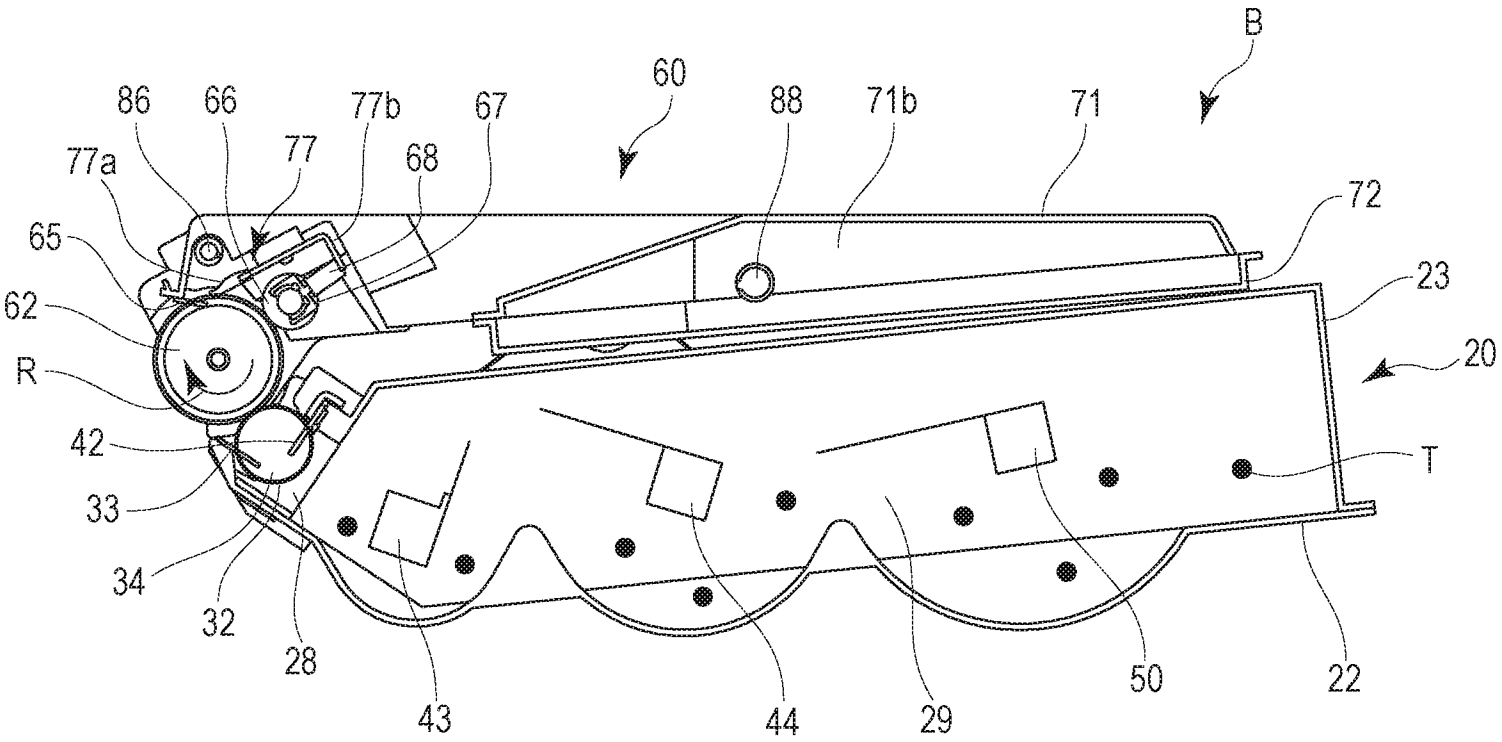
FIG. 3 is a cross-sectional view of the process cartridge.

The overall configuration and the image forming process will be described with reference to FIGS. 2 and 3. FIG. 2 is a cross-sectional view of an image forming apparatus main body (hereinafter referred to as "apparatus main body A") and a process cartridge (hereinafter referred to as "cartridge B" of an electrophotographic image forming apparatus according to an embodiment of the present disclosure. FIG. 3 is a cross-sectional view of the cartridge B viewed from the rotational axis direction of the photosensitive drum 62.

The apparatus main body A is a portion of the electrophotographic image forming apparatus excluding the cartridge B.

Overall Configuration of Electrophotographic Image Forming Apparatus

The electrophotographic image forming apparatus illustrated in FIG. 2 is a laser beam printer using an electrophotographic technique in which the cartridge B can be mounted in the apparatus main body A. When the cartridge B is mounted in the apparatus main body A, an exposing unit 3 (a laser scanner unit) for forming a latent image on the photosensitive drum 62 of the cartridge B is disposed. A sheet tray 4 on which recording media (hereinafter referred to as "sheet material P") on which images are to be formed are placed is disposed below the cartridge B.

The apparatus main body A further includes a pick-up roller 5*a*, a feed roller pair 5*b*, a conveying roller pair 5*c*, a transfer guide 6, a transfer roller 7, a conveyance guide 8, a fixing unit 9, a discharge roller pair 10, and an output tray 11, which are disposed in sequence in the conveying direction D of the sheet material P. The fixing unit 9 includes a heating roller 9*a* and a pressure roller 9*b*.

Image Forming Process

The outline of the image forming process will be described. The electrophotographic photosensitive drum (hereinafter referred to as "drum 62") is rotationally driven in the direction of arrow R at a predetermined circumferential speed (a processing speed) on the basis of a print start signal. A charging roller 66 to which a bias voltage is applied is in contact with the outer circumferential surface of the drum 62 to uniformly charge the outer circumferential surface of the drum 62.

The exposing unit 3 outputs a laser beam L corresponding to image information. The laser beam L passes through a laser opening 71*h* in a cleaning frame 71 of the cartridge B and scans the outer circumferential surface of the drum 62 for exposure. Thus, an electrostatic latent image corresponding to the image information is formed on the outer circumferential surface of the drum 62.

In a developing unit 20 serving as a developing apparatus, toner T in a toner chamber 29 is stirred and conveyed by the rotation of a first conveying member 43, a second conveying member 44, and a third conveying member 50 into a toner supply chamber 28, as shown in FIG. 3. The toner T is born on the surface of a developing roller 32 by the magnetic force of a magnet roller 34 (a fixed magnet). The thickness of the toner T on the circumferential surface of the developing roller 32 is regulated by a developing blade 42 while being frictionally charged.

The toner T is developed as a toner image on the drum 62 according to the electrostatic latent image.

Referring to FIG. 2, the sheet materials P in the sheet tray 4 at the lower portion of the apparatus main body A are fed out by the pick-up roller 5*a*, the feed roller pair 5*b*, and the conveying roller pair 5*c* in timing with the output of the laser beam L. The sheet materials P pass through the transfer guide 6 and are conveyed to a transfer position between the drum 62 and the transfer roller 7. At the transfer position, the toner image is transferred from the drum 62 to the sheet materials P in sequence.

Each sheet material P on which the toner image is transferred is separated from the drum 62 and is conveyed to the fixing unit 9 along the conveyance guide 8. The sheet material P then passes through a nip between the heating roller 9*a* and the pressure roller 9*b* constituting the fixing unit 9. The toner image is subjected to pressing and heating process at the nip and thus fixed to the sheet material P. The sheet materials P subjected to the toner-image fixing process are conveyed to the discharge roller pair 10 and are discharged onto the output tray 11.

Referring to FIG. 3, remaining toner on the outer circumferential surface of the drum 62 after the transfer process is removed by a cleaning blade 77, and the drum 62 is used for forming an image again. The toner removed from the drum 62 is stored in a waste toner chamber 71*b* of a cleaning unit 60.

The charging roller 66, the developing roller 32, the transfer roller 7, and the cleaning blade 77 are processing units for the drum 62.

Mounting and Demounting Cartridge

Figure 5:
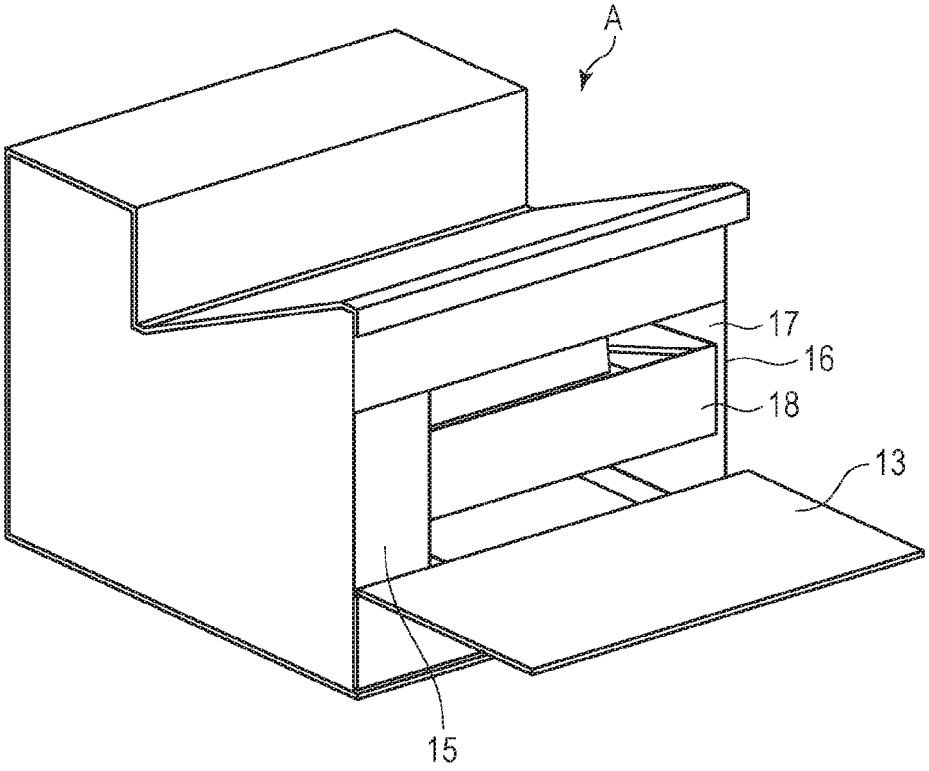
FIG. 5 is a perspective view of the electrophotographic image forming apparatus main body in a state in which an openable cover is opened.
Figure 6:
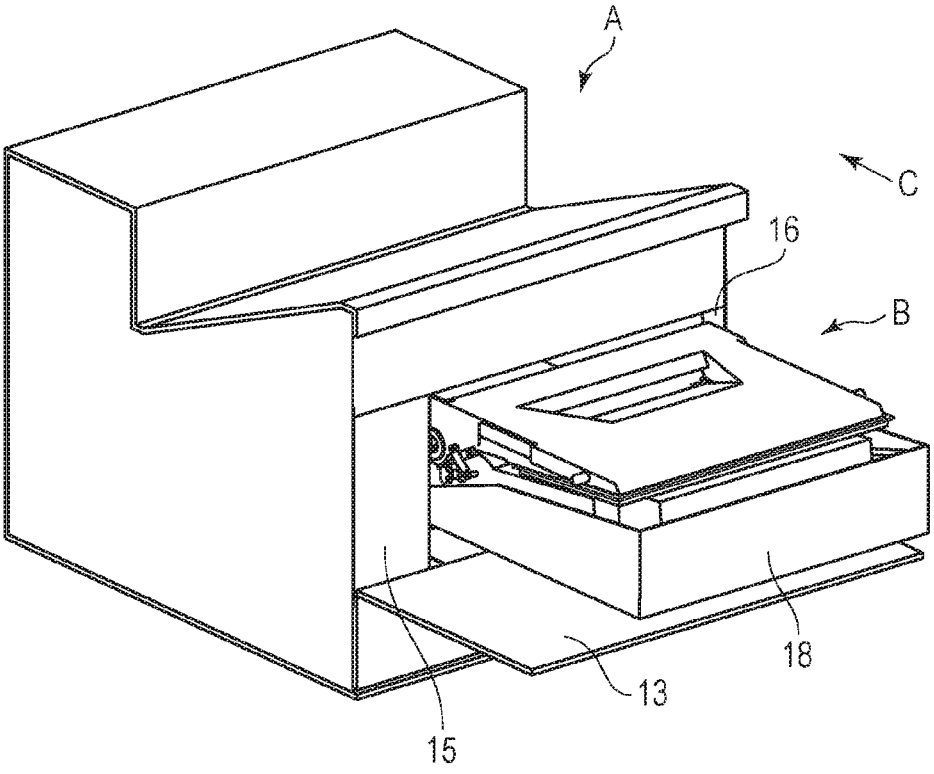
FIG. 6 is a perspective view of the electrophotographic image forming apparatus main body and the process cartridge in a state in which the openable cover is opened and a tray is drawn.
Figure 7:
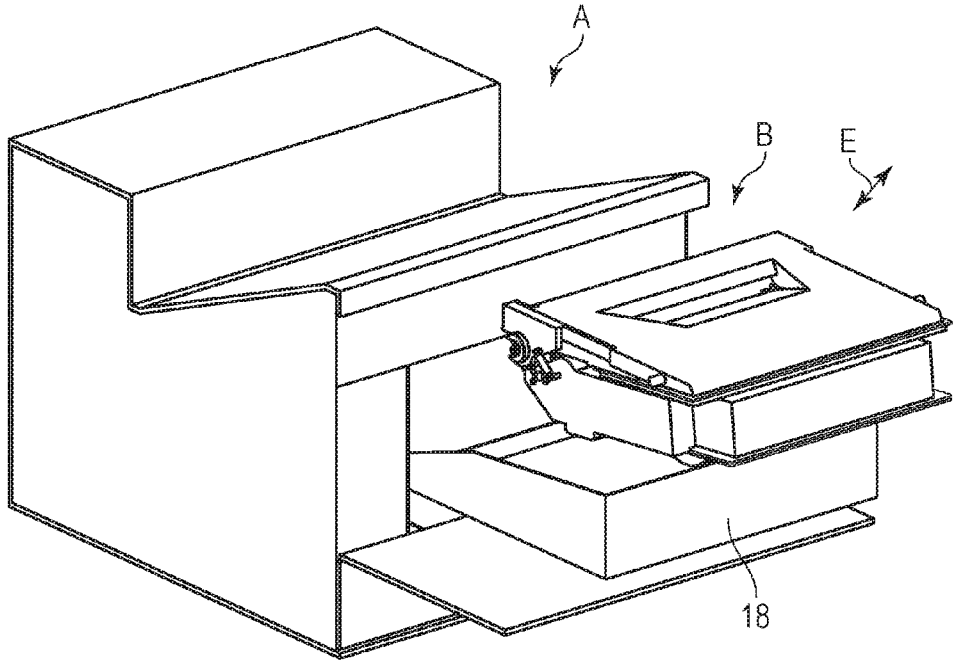
FIG. 7 is a perspective view of the electrophotographic image forming apparatus main body and the cartridge in a state in which the cartridge is mounted or demounted, with the openable cover opened and the tray drawn.

Mounting and demounting of the cartridge B to and from the apparatus main body A will be described with reference to FIGS. 5 to 8. FIG. 5 is a perspective view of the apparatus main body A in a state in which an openable cover 13 is opened to mount or demount the cartridge B. FIG. 6 is a perspective view of the apparatus main body A and the cartridge B in a state in which the openable cover 13 is opened to mount or demount the cartridge B and a tray 18 is drawn. FIG. 7 is a perspective view of the apparatus main body A and the cartridge B in a state in which the cartridge B is mounted or demounted, with the openable cover 13 opened and the tray 18 drawn. The cartridge B can be mounted or demounted to or from the tray 18 in a mounting and demounting direction E.

The openable cover 13 is rotatably attached to the apparatus main body A. The apparatus main body A has a cartridge insertion opening 17 on the back of the openable cover 13. The tray 18 for mounting the cartridge B in the apparatus main body A is disposed in the cartridge insertion opening 17. When the tray 18 is drawn to a predetermined position, the cartridge B can be mounted or demounted. The cartridge B, placed on the tray, is mounted into the apparatus main body A along a guide rail (not shown) in the direction of arrow C.

Figure 8:
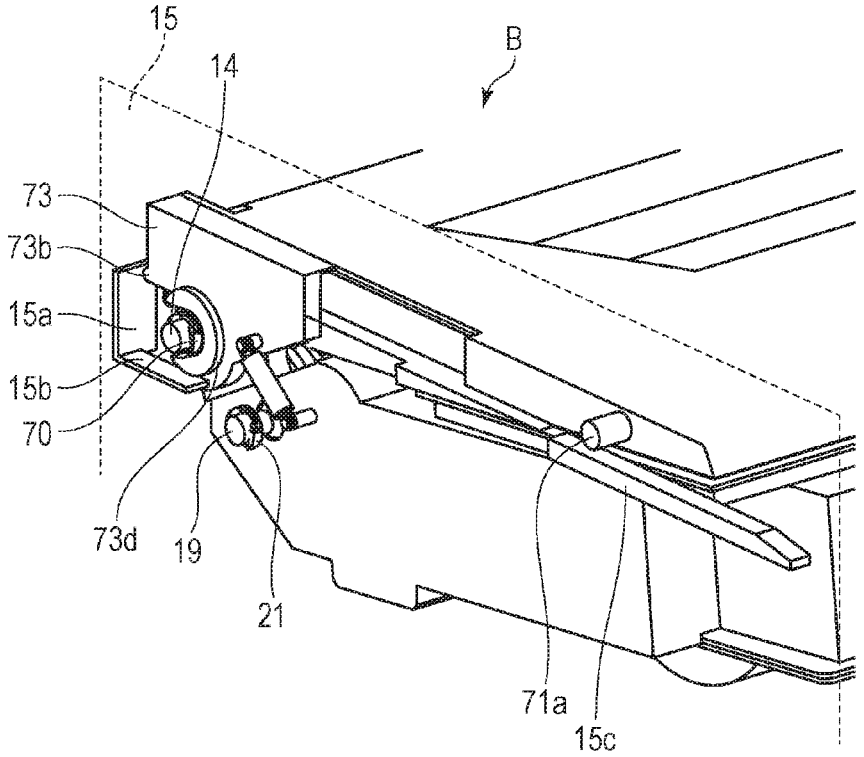
FIG. 8 is a perspective view of the process cartridge and the drive-side positioning portion of the electrophotographic image forming apparatus in a state in which the process cartridge is mounted in the apparatus main body.

As shown in FIG. 8, the apparatus main body A includes a first engaging portion 14 and a second engaging portion 19 for transmitting driving to a first coupling member 70 and a second coupling member 21 of the cartridge B. In mounting or demounting the cartridge B, the first coupling member 70 and the second coupling member 21 respectively engage with or disengage from the first engaging portion 14 and the second engaging portion 19 while tilting and rotating.

The first engaging portion 14 and the second engaging portion 19 are driven by a motor (not shown) of the apparatus main body A. This causes the drum 62 connected to the first coupling member 70 to be rotated by the driving force from the apparatus main body A. The developing roller 32 is rotated by the driving force transmitted by the second coupling member 21. The charging roller 66 and the developing roller 32 are supplied with power from a power feeding unit (not shown) of the apparatus main body A.

Cartridge Support

Figure 9:
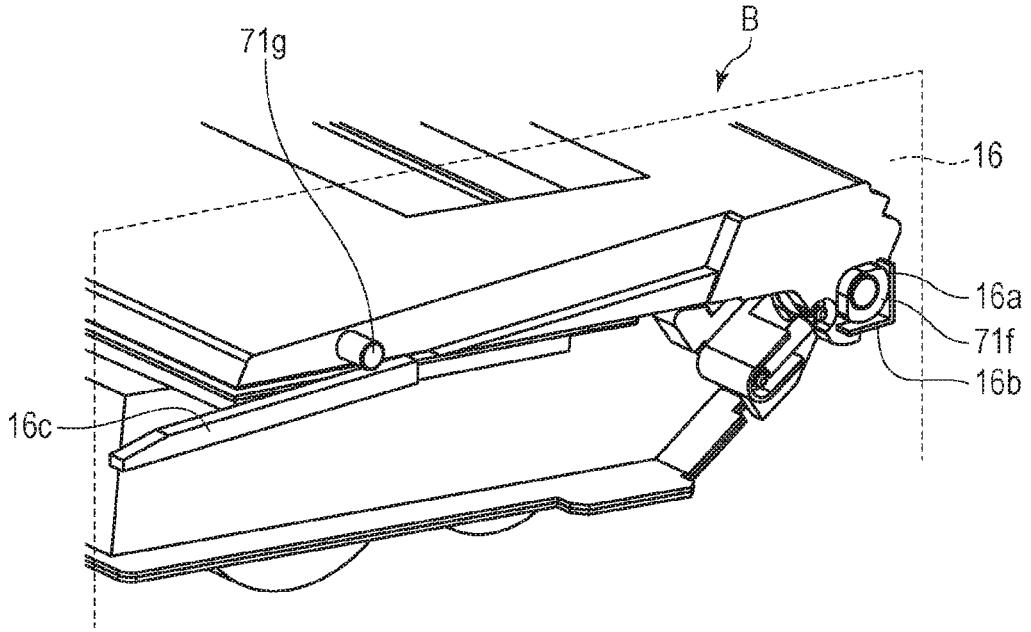
FIG. 9 is a perspective view of the process cartridge and the non-drive-side positioning portion of the electrophotographic image forming apparatus in a state in which the process cartridge is mounted in the apparatus main body.

As shown in FIG. 5, the apparatus main body A includes a drive-side plate 15 and a non-drive-side plate 16 for supporting the cartridge B. As shown in FIG. 8, the drive-side plate 15 has a drive-side first supporting portion 15*a*, drive-side second supporting portion 15*b*, and a rotation supporting portion 15*c* for the cartridge B. As shown in FIG. 9, the non-drive-side plate 16 has a non-drive-side first supporting portion 16*a*, a non-drive-side second supporting portion 16*b*, and a rotation supporting portion 16*c*.

The cartridge B has, as supported portions, a supported portion 73*b* and a supported portion 73*d* of a drum bearing 73, and a drive-side boss 71*a*, a non-drive-side protrusion 71*f*, and a non-drive-side boss 71*g* of the cleaning frame 71. The supported portion 73*b* is supported by the drive-side first supporting portion 15*a*. The supported portion 73*d* is supported by the drive-side second supporting portion 15*b*. The drive-side boss 71*a* is supported by the rotation supporting portion 15*c*. The non-drive-side protrusion 71*f* is supported by the non-drive-side first supporting portion 16*a* and the non-drive-side second supporting portion 16*b*, and the non-drive-side boss 71*g* is supported by the rotation supporting portion 16*c*, so that the cartridge B is positioned in the apparatus main body A.

Overall Configuration of Cartridge

Figure 10:
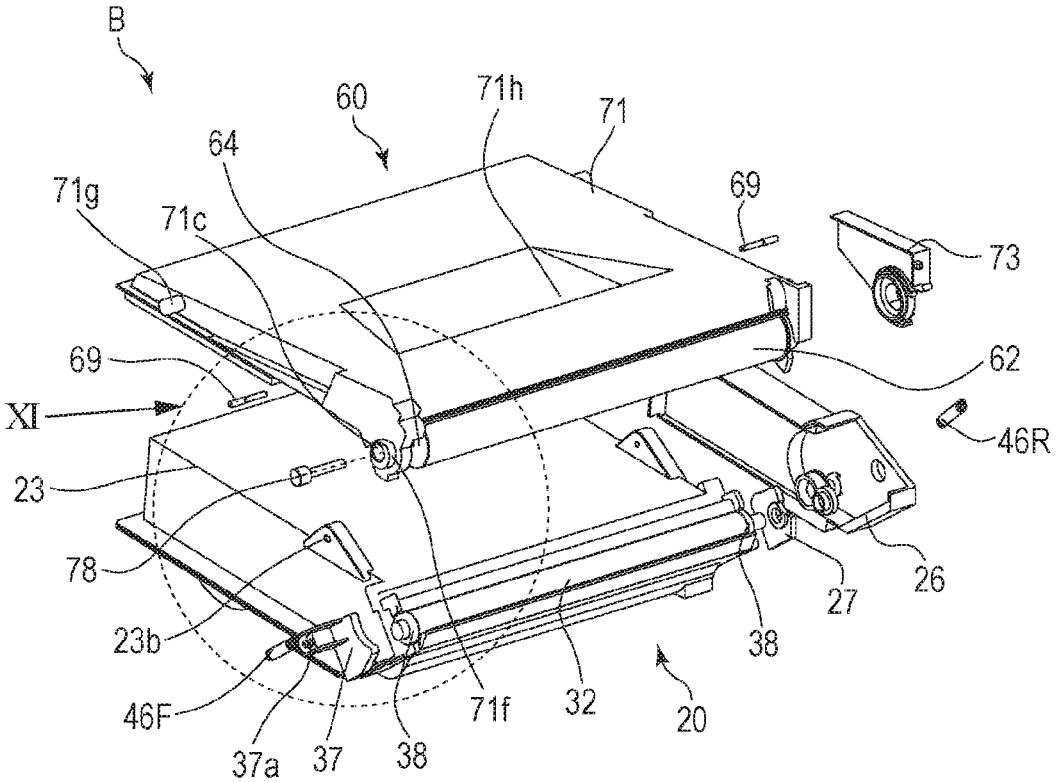
FIG. 10 is an exploded view of the process cartridge.
Figure 11:
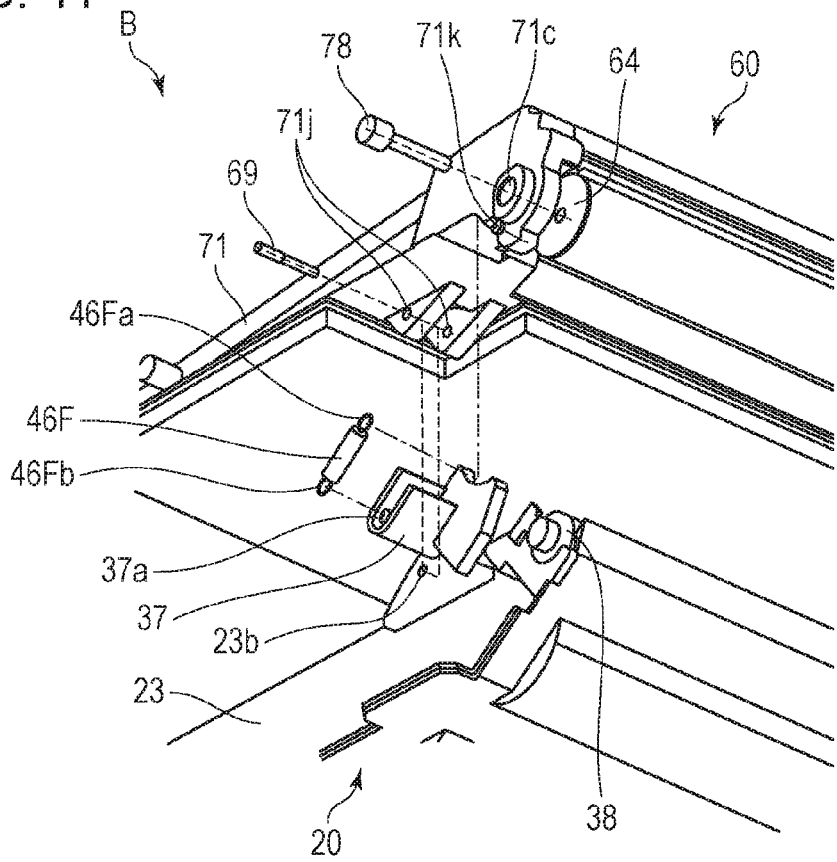
FIG. 11 is an exploded view of the process cartridge.
Figure 12:
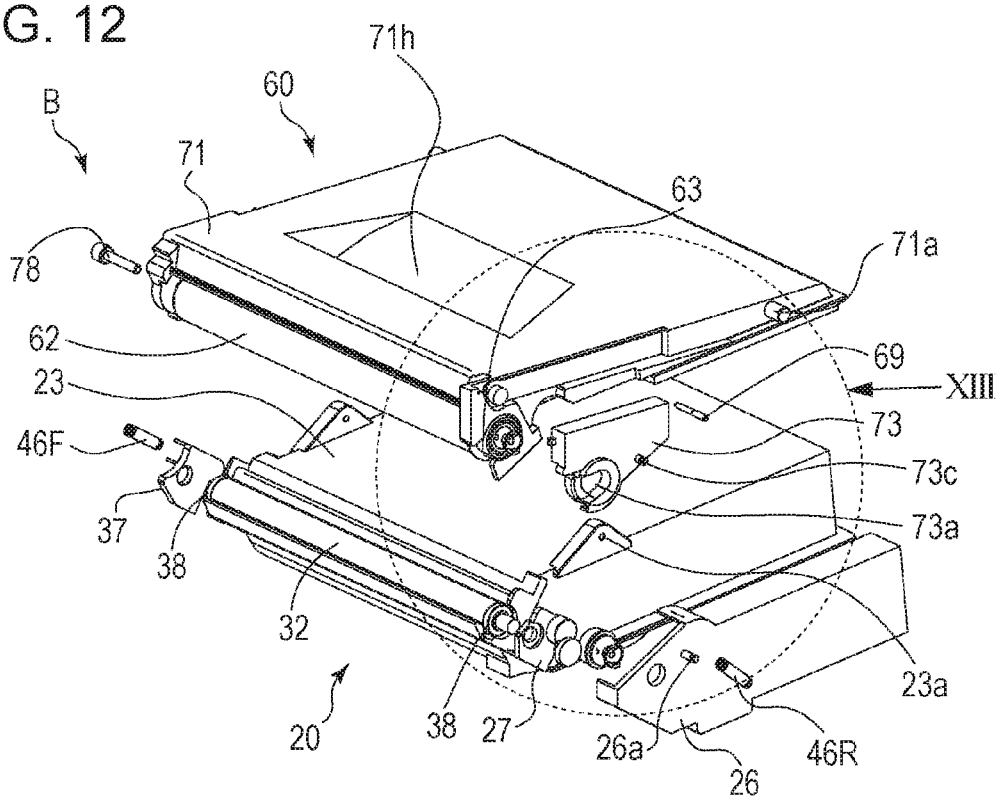
FIG. 12 is an exploded view of the process cartridge.
Figure 13:
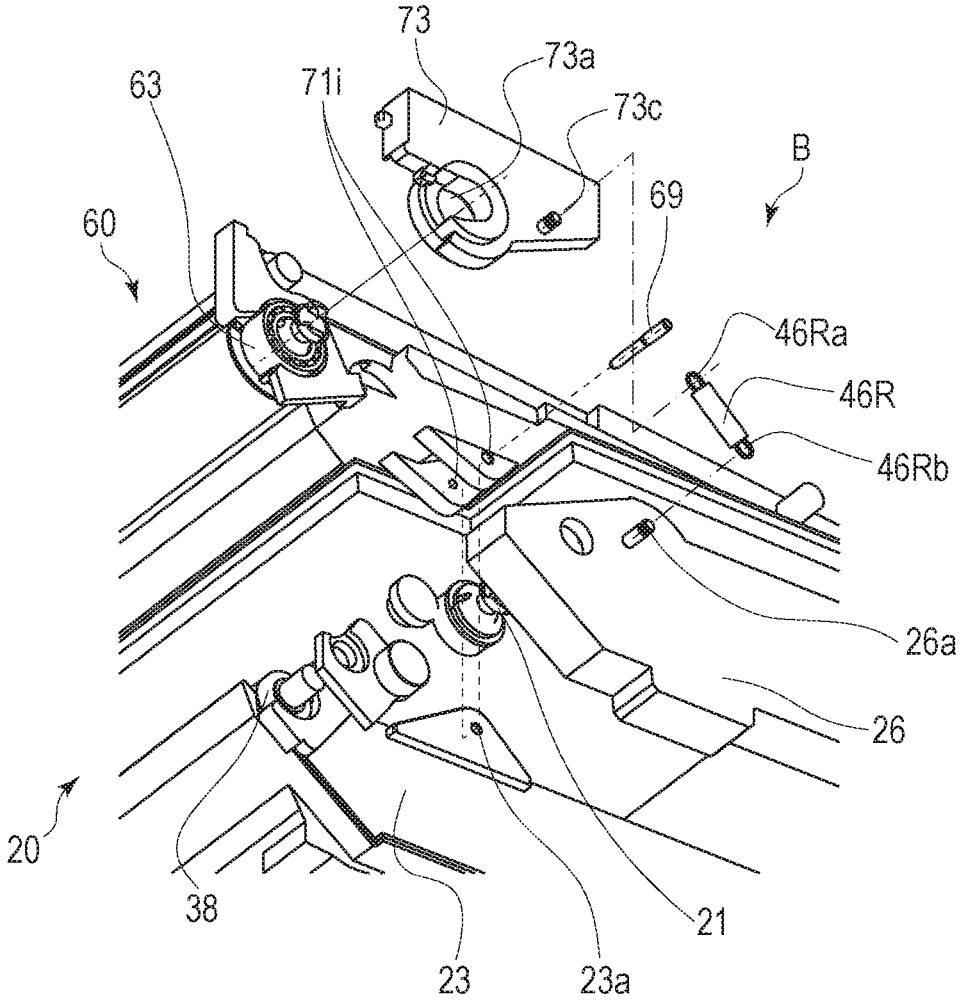
FIG. 13 is an exploded view of the process cartridge.

Next, the overall configuration of the cartridge B will be described with reference to FIGS. 3 and 4 and FIGS. 10 to 13. FIG. 3 is a cross-sectional view of the cartridge B, and FIGS. 10 to 13 are perspective views of the cartridge B illustrating the configuration. FIGS. 11 and 13 are respective partial enlarged views of the portions enclosed by the dotted lines in FIGS. 10 and 12, viewed at different angles. In this embodiment, screws for joining the components are omitted.

The cartridge B includes the cleaning unit 60 and the developing unit 20. The process cartridge is a combination of an electrophotographic photosensitive member and at least one of a developing unit, a charging unit, and a cleaning unit, serving as processing units for the electrophotographic photosensitive member, and is detachably mounted in an electrophotographic image forming apparatus main body. In some embodiments of the present disclosure, the process cartridge includes at least the cleaning unit 60 according to an embodiment of the present disclosure.

As shown in FIG. 3, the cleaning unit 60 includes the drum 62, the charging roller 66, the cleaning member 77, the cleaning frame 71 for supporting them, and a cover member 72 secured to the cleaning frame 71 by welding, for example. In the cleaning unit 60, the charging roller 66 and the cleaning member 77 are in contact with the outer circumferential surface of the drum 62.

The cleaning member 77 includes a rubber blade 77*a* which is a blade-like elastic member and a supporting member 77*b* that supports the rubber blade 77*a*. The rubber blade 77*a* is in contact with the drum 62 in a direction counter to the rotating direction of the drum 62. In other words, the rubber blade 77*a* is in contact with the drum 62 in such a manner that the end faces upstream in the rotating direction of the drum 62.

Figure 4A:
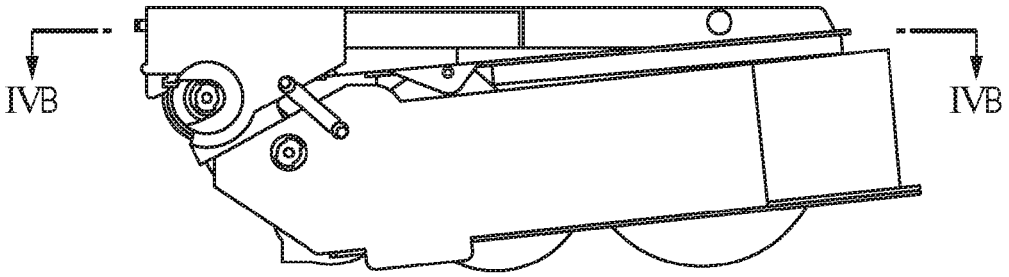
FIG. 4A is a diagram of the process cartridge viewed from the rotational axis direction of the drum.
Figure 4B:
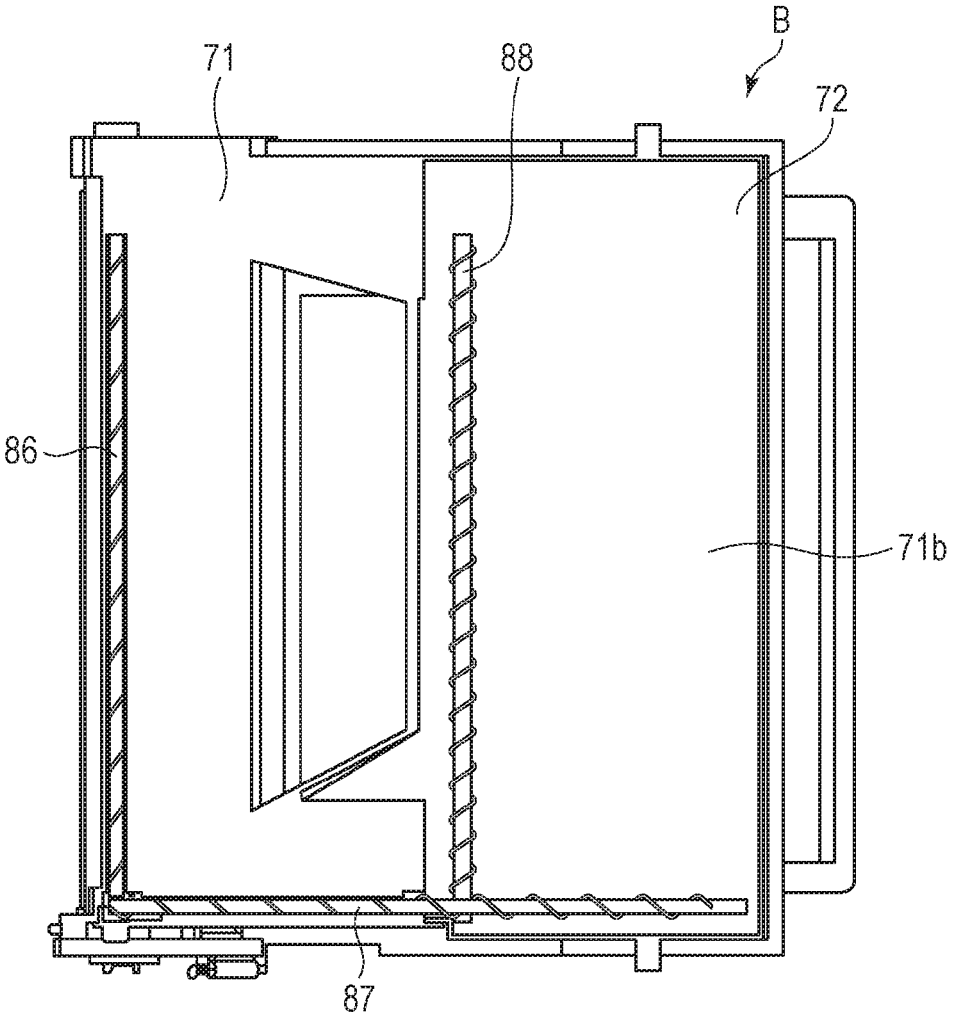
FIG. 4B is a diagram illustrating the interior of a cleaning frame taken along line IVB-IVB in FIG. 4A.

FIG. 4A is a diagram of the cartridge B viewed from the rotational axis direction of the drum 62. FIG. 4B is a diagram illustrating the interior of the cleaning frame 71 taken along line IVB-IVB in FIG. 4A. As shown in FIG. 3 and FIGS. 4A and 4B, waste toner removed from the surface of the drum 62 by the cleaning member 77 is conveyed with a first screw 86, a second screw 87, and a third screw 88 serving as waste toner conveying members. The waste toner is stored in a waste toner chamber 71*b* formed of the cleaning frame 71 and the cover member 72. The first screw 86 rotates by the driving force transmitted by a gear (not shown) through the second coupling member 21, shown in FIG. 13. The second screw 87 rotates by the driving force from the first screw 86, and the third screw 88 rotates by the driving force from the second screw 87. The first screw 86 is disposed in the vicinity of the drum 62. The second screw 87 is disposed at an end of the cleaning frame 71 in the longitudinal direction. The third screw 88 is disposed in the waste toner chamber 71*b*. The rotation axes of the first screw 86 and the third screw 88 are parallel to the rotation axis of the drum 62, and the rotation axis of the second screw 87 is perpendicular to the rotation axis of the drum 62.

As shown in FIG. 3, a scooping sheet 65 for preventing waste toner from leaking from the cleaning frame 71 is disposed at the edge of the cleaning frame 71 in such a manner as to be in contact with the drum 62.

The first coupling member 70 (FIG. 8) joined to the drum 62 is subjected to a driving force transmitted from a main-body drive motor (not shown) serving as a driving source, so that the drum 62 is rotationally driven in the direction of arrow R according to an image forming operation.

The charging roller 66 is rotatably attached to the cleaning unit 60 at both ends of the cleaning frame 71 in the longitudinal direction (substantially parallel to the rotation axis direction of the drum 62) via a charging-roller bearing 67. The charging roller 66 is in pressure-contact with the drum 62 under the pressure of the charging-roller bearing 67 urged by an urging member 68 toward the drum 62. The charging roller 66 is rotated with the rotation of the drum 62.

As shown in FIG. 3, the developing unit 20 includes the developing roller 32, a developer container 23 that supports the developing roller 32, and the developing blade 42. The developing roller 32A includes the magnet roller 34 therein. The developing blade 42 in the developing unit 20 is used to regulate the toner layer on the developing roller 32. As shown in FIGS. 10 and 12, interval holding members 38 are attached to both ends of the developing roller 32. The interval holding members 38 are in contact with the drum 62 to hold the developing roller 32 at a small interval from the drum 62. As shown in FIG. 3, a leakproof sheet 33 for preventing the toner T from leaking from the developing unit 20 is disposed at the edge of a bottom member 22 in such a manner as to be in contact with the developing roller 32. Furthermore, the toner chamber 29 constituted of the developer container 23 and the bottom member 22 contains the first conveying member 43, the second conveying member 44, and the third conveying member 50. The first conveying member 43, the second conveying member 44, and the third conveying member 50 stir the toner T contained in the toner chamber 29 and convey the toner T into the toner supply chamber 28.

As shown in FIGS. 10 and 12, the cartridge B is composed of the cleaning unit 60 and the developing unit 20.

The cleaning unit 60 includes the cleaning frame 71, the cover member 72, the drum 62, and the drum bearing 73 and a drum shaft 78 for rotationally supporting the drum 62. The cleaning frame 71, the cover member 72, the drum bearing 73, and the drum shaft 78 are drum supporting members for rotatably supporting the drum 62. Referring to FIG. 13, at the drive-side, the drum 62 is rotatably supported by a drive-side drum flange 63, which is a flange member disposed at the drive-side, and a bearing 73*a* of the drum bearing 73. Referring to FIG. 11, at the non-drive-side, the drum shaft 78 press-fitted in a hole 71*c* in the cleaning frame 71 rotatably supports a hole 64*a* in a non-drive-side drum flange 64 (FIG. 14B).

Referring to FIGS. 3, 10, and 12, the developing unit 20 includes the bottom member 22, the developer container 23, a drive-side development side member 26, the developing blade 42, and the developing roller 32. The developing roller 32 is rotatably attached to the developer container 23 with bearing members 27 and 37 disposed at both ends.

Referring to FIGS. 11 and 13, by rotatably joining the cleaning unit 60 and the developing unit 20 together with connecting pins 6, the cartridge B is formed.

Specifically, the developer container 23 has a first development supporting hole 23*a* and a second development supporting hole 23*b* at both ends of the developing unit 20 in the longitudinal direction. The cleaning frame 71 has first suspending holes 71*i* and second suspending holes 71*j* at both ends of the cleaning unit 60 in the longitudinal direction. Connecting pins 69 press-secured in the first suspending holes 71*i* and the second suspending holes 71*j* respectively engage the first development supporting hole 23*a* and the second development supporting hole 23*b* to rotatably join the cleaning unit 60 and the developing unit 20 together.

A first hole 46Ra of a drive-side urging member 46R is hooked on a boss 73*c* of the drum bearing 73, and a second hole 46Rb is hooked on a boss 26*a* of the drive-side development side member 26.

A first hole 46Fa of a non-drive-side urging member 46F is hooked on a boss 71*k* of the cleaning frame 71, and a second hole 46Fb is hooked on a boss 37*a* of the bearing member 37.

In this embodiment, the drive-side urging member 46R and the non-drive-side urging member 46F are tension springs. The developing unit 20 is urged to the cleaning unit 60 by the urging force of the tension springs so that the developing roller 32 is reliably pushed toward the drum 62. The interval holding members 38 attached to both ends of the developing roller 32 hold the developing roller 32 at a predetermined interval from the drum 62.

Electrophotographic Photosensitive Drum Unit

Figure 14A:
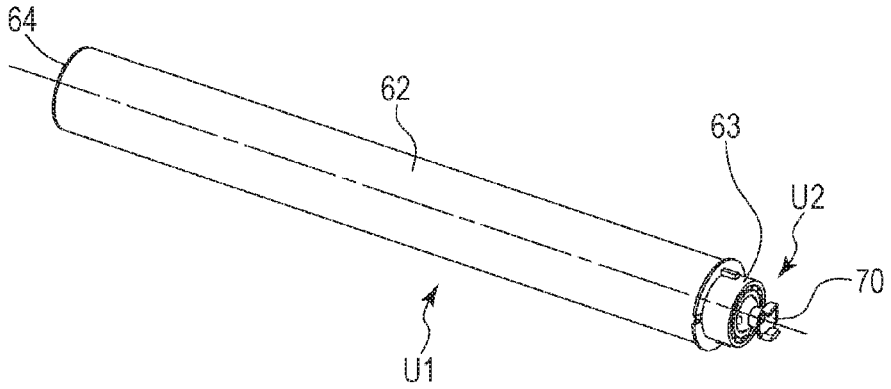
FIG. 14A is a perspective view of a electrophotographic photosensitive drum unit viewed from the drive side.
Figure 14B:
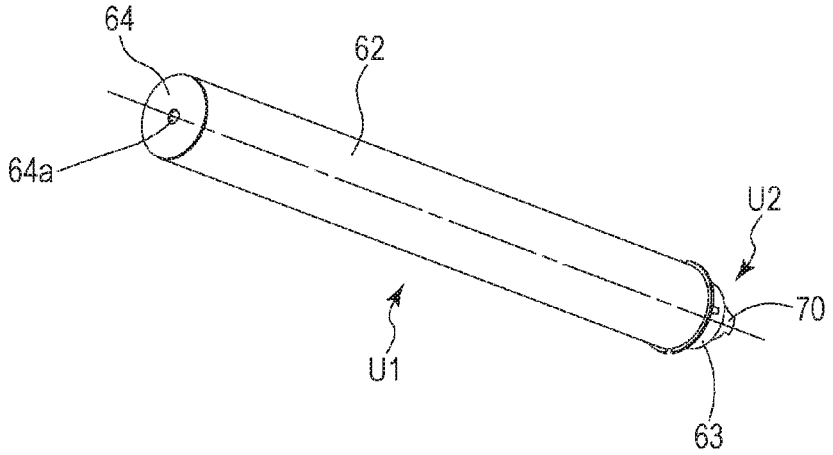
FIG. 14B is a perspective view of the electrophotographic photosensitive drum unit viewed from the non-drive side.
Figure 14C:
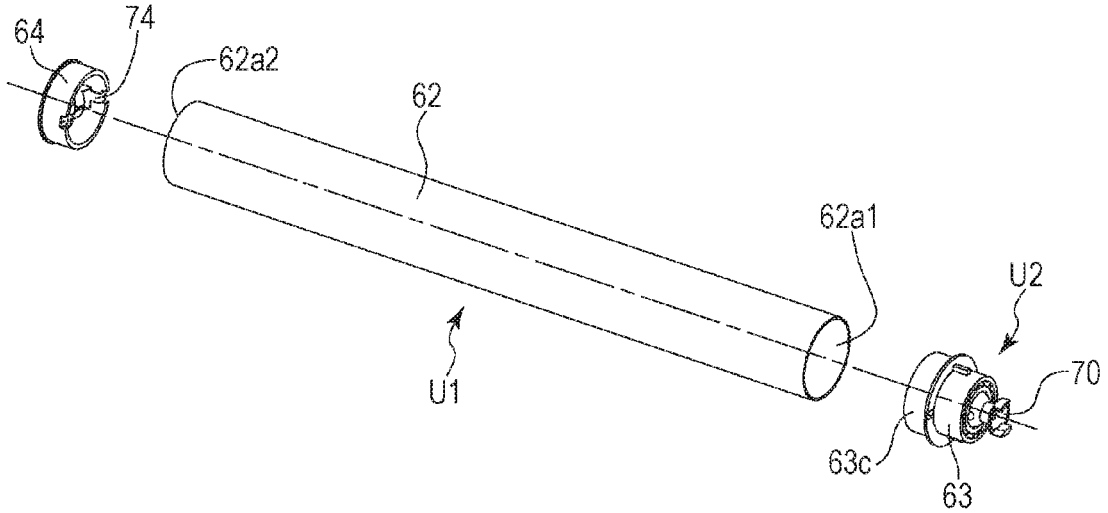
FIG. 14C is an exploded perspective view of the electrophotographic photosensitive drum unit.

Referring to FIGS. 14A to 14C, the configuration of an electrophotographic photosensitive drum unit U1 (hereinafter referred to as "drum unit U1") will be described. FIGS. 14A to 14C illustrate the drum unit U1. FIG. 14A is a perspective view of the drum unit U1 viewed from the drive side, FIG. 14B is a perspective view of the electrophotographic photosensitive drum unit viewed from the non-drive side, and FIG. 14C is an exploded perspective view of the electrophotographic photosensitive drum unit.

As shown in FIGS. 14A to 14C, the drum unit U1 includes the drum 62, a drive-side flange unit U2, the non-drive-side drum flange 64, and a grounding plate 74.

The drum 62 is an electrically conductive cylindrical member made of aluminum and is coated with a photosensitive layer. The drum 62 may be either hollow or solid.

The drive-side flange unit U2 is disposed at an end on the drive side of the drum 62. Specifically, the drive-side flange unit U2 is joined to the drum 62 in such a manner that a third cylindrical portion 63*c* of the drive-side drum flange 63 is fit in an opening 62*a*1 at an end of the drum 62 and is then bonded or swaged together. When the drive-side flange unit U2 rotates, the drum 62 rotates together therewith.

Figure 15A:
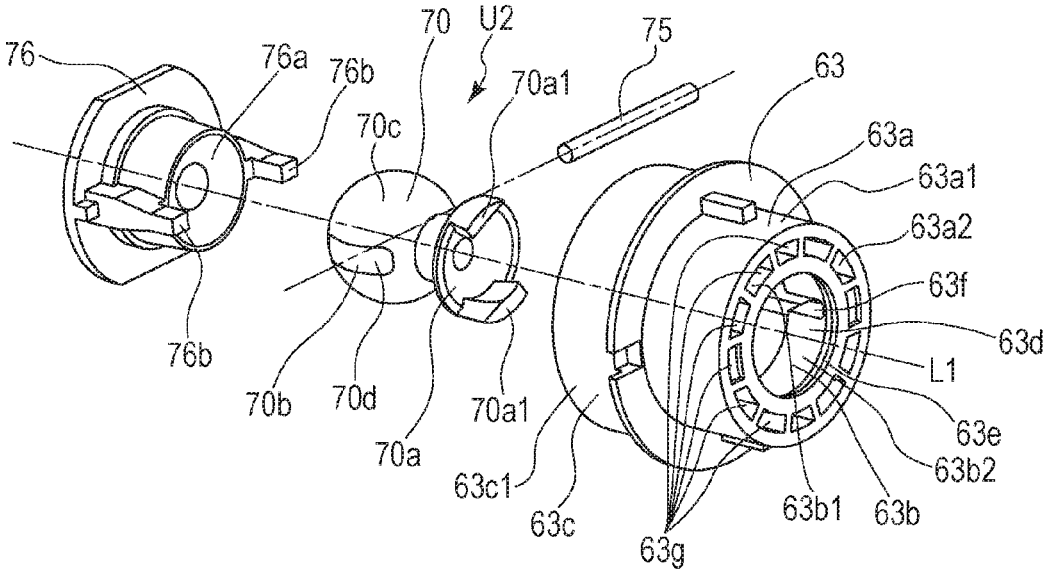
FIG. 15A is an exploded perspective view of a drive-side flange unit viewed from the drive side.
Figure 15B:
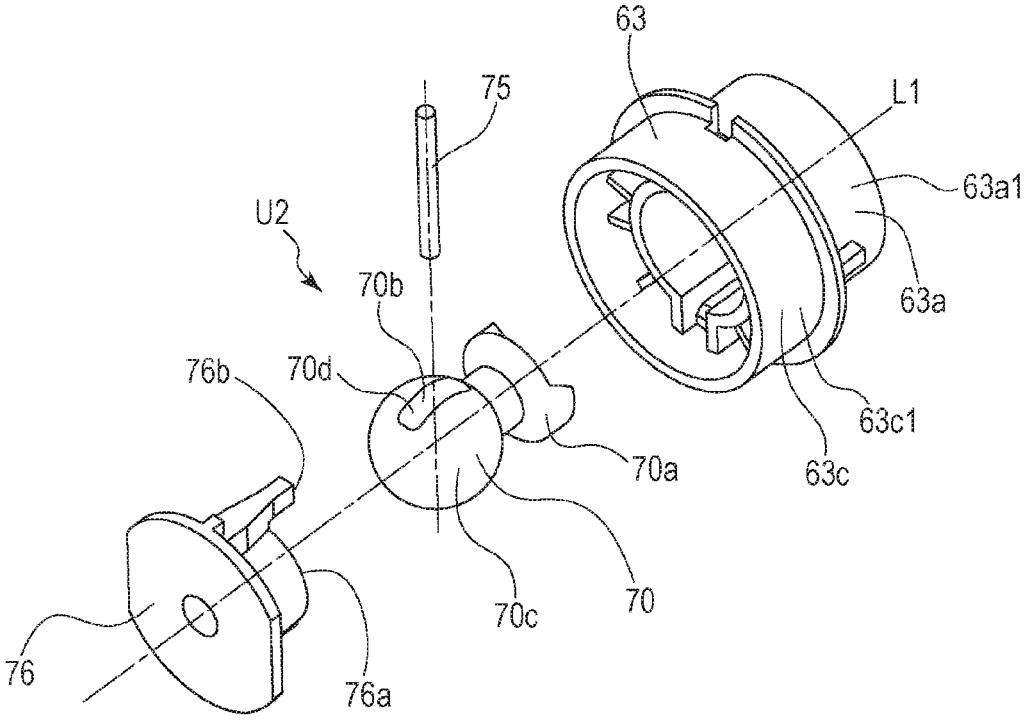
FIG. 15B is an exploded perspective view of the drive-side flange unit viewed from the non-drive side.

Likewise, the non-drive-side drum flange 64 is disposed at an end on the non-drive side of the drum 62. The non-drive-side drum flange 64 is made of resin and is bonded or swaged to an opening 62*a*2 at the end of the drum 62. The non-drive-side drum flange 64 has an electrically conductive (generally metal) grounding plate 74 to ground the drum 62. The grounding plate 74 is in contact with the inner circumferential surface of the drum 62 to be electrically coupled to the apparatus main body A. Drive-Side Flange Unit Referring to FIGS. 15A and 15B and FIGS. 16A to 16C, the configuration of the drive-side flange unit U2 will be described. FIGS. 15A and 15B are exploded perspective views of the drive-side flange unit U2. FIG. 15A is a diagram of the drive-side flange unit U2 viewed from the drive side, and FIG. 15B is a diagram of the drive-side flange unit U2 viewed from the non-drive side.

Figure 16A:
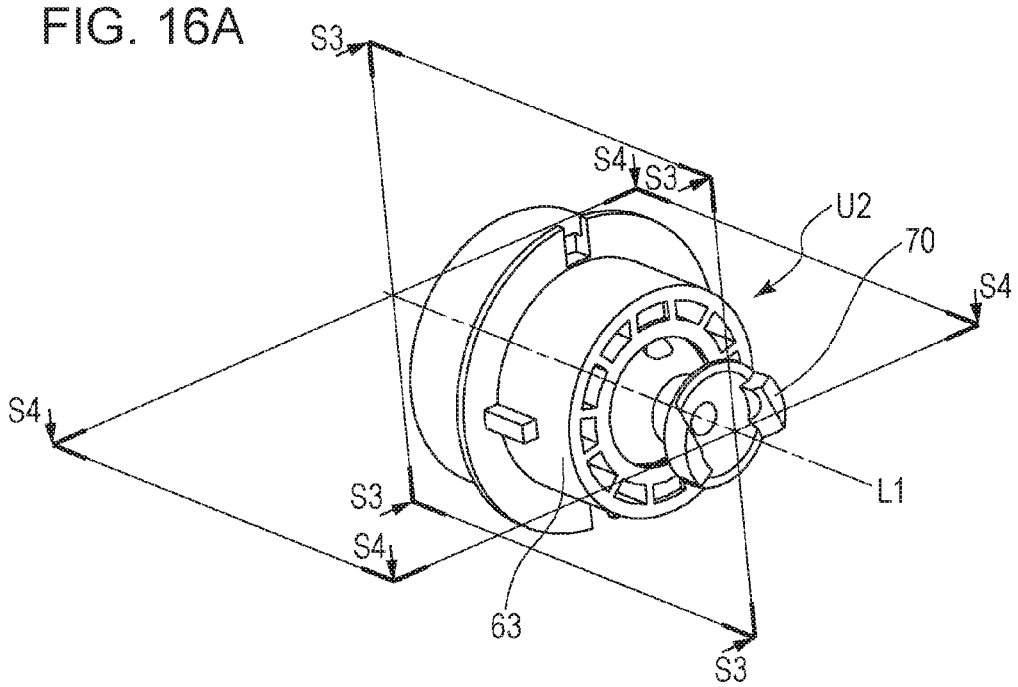
FIG. 16A is a perspective view of the drive-side flange unit viewed from the drive side.
Figure 16B:
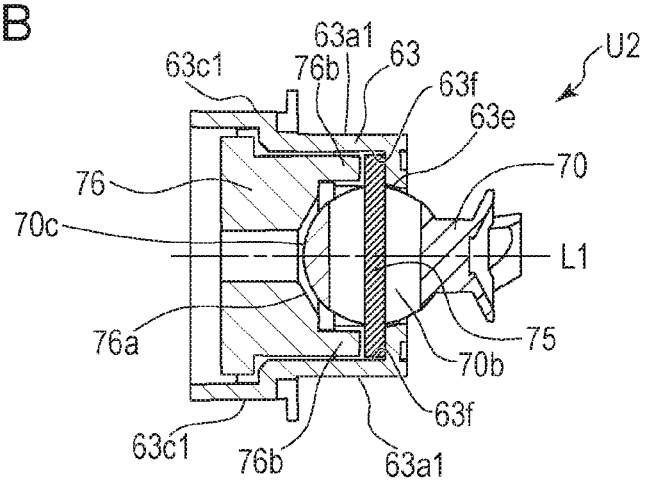
FIG. 16B is a cross-sectional view of the drive-side flange unit taken along plane S3 in FIG. 16A.
Figure 16C:
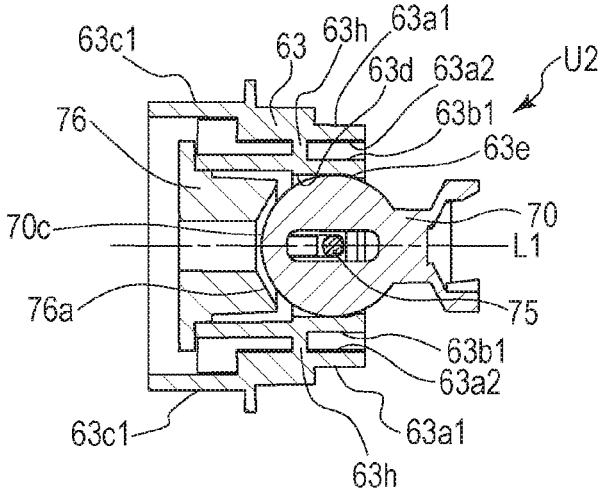
FIG. 16C is a cross-sectional view of the drive-side flange unit taken along plane S4 in FIG. 16A.

FIGS. 16A to 16C are diagrams illustrating the drive-side flange unit U2. FIG. 16A is a perspective view of the drive-side flange unit U2 viewed from the drive side, FIG. 16B is a cross-sectional view taken along plane S3 in FIG. 16A, and FIG. 16C is a cross-sectional view taken along plane S4 in FIG. 16A. The plane S3 and the plane S4 each include an axis L1 (described later) and intersect each other at right angles.

As shown in FIGS. 15A and 15B, the drive-side flange unit U2 includes the first coupling member 70, the drive-side drum flange(flange member) 63, a pin 75, and a restricting member 76.

The first coupling member 70 includes a free end 70*a* and a joining portion 70*c*. The free end 70*a* includes receiving portions 70*a*1 that engage with the first engaging portion 14 of the apparatus main body A (FIG. 8) to receive a rotational force. The joining portion 70*c* includes a hole 70*b*, or a through-hole, and a transmitting portion 70*d* for transmitting the rotational force received with the receiving portions 70*a*1.

The drive-side drum flange 63 includes a first cylindrical portion 63*a*, a second cylindrical portion 63*b*, and a third cylindrical portion 63*c*. The central axis L1 of the first cylindrical portion 63*a* is aligned with the central axis of the second cylindrical portion 63*b* and the central axis of the third cylindrical portion 63*c*. Let the outer circumferential surface of the first cylindrical portion 63*a* be 63*a*1, the inner circumferential surface be 63*a*2, the outer circumferential surface of the second cylindrical portion 63*b* be 63*b*1, the inner circumferential surface be 63*b*2, and the outer circumferential surface of the third cylindrical portion 63*c* be 63*c*1. The axis L1 is aligned with the central axis of the drum 62. In other words, the first cylindrical portion 63*a*, the second cylindrical portion 63*b*, and the third cylindrical portion 63*c* are disposed so that they have the same central axis.

The second cylindrical portion 63*b* has a hollow 63*d* including the axis L1 and passing through the drive-side drum flange 63. The second cylindrical portion 63*b* further has a smallest-diameter portion 63*e* whose inner diameter is the smallest of the inner circumferential surface 63*b*2 of the second cylindrical portion 63*b* and two recessed portions 63*f* recessed outwards in the radial direction from the inner circumferential surface 63*b*2 of the second cylindrical portion 63*b*. The smallest-diameter portion 63*e* is an inward protrusion that protrudes from the inner circumferential surface 63*b*2 of the second cylindrical portion 63*b* toward the axis L1. The recessed portions 63*f* are grooves extending along the axis L1 (along the central axis). The hollow 63*d* is a housing portion that houses the joining portion 70*c* of the first coupling member 70. The pin 75 is a columnar (or cylindrical) shaft disposed so that the longitudinal direction is substantially perpendicular to the axis L1.

The restricting member 76 is opposed to the smallest-diameter portion 63*e*, with the joining portion 70*c* of the first coupling member 70 in between in the axis L1 direction, and includes a first restricting portion 76*a* and two second restricting portions 76.

Next, a method of supporting the components will be described with reference to FIGS. 16A to 16C. The position of the first coupling member 70 in the direction perpendicular to the axis L1 is determined by the joining portion 70*c* held in the hollow 63*d* of the second cylindrical portion 63*b*. The position of the joining portion 70*c* in the direction of the axis L1 is restricted by the smallest-diameter portion 63*e* and the first restricting portion 76*a* serving as a retainer. In this case, the rotation of the first coupling member 70 about the center of the joining portion 70*c* is not restricted, so that the first coupling member 70 is capable of tilting about the center of the joining portion 70*c*. Being capable of tilting refers to that the first coupling member 70 can rotate about the center of the joining portion 70*c* in such a manner that the center line of the first coupling member 70 tilts with respect to the axis L1.

The two recessed portions 63*f* are disposed at symmetric positions about the axis L1. Both ends of the pin 75 passing through the hole 70*b* are inserted in the two recessed portions 63*f* to restrict the rotation about the axis L1. For the direction of the axis L1, the two recessed portions 63*f* and the two second restricting portions 76*b* serving as retainers for the pin 75 restrict the position.

The restricting member 76 is fixed to the drive-side drum flange 63 by welding or bonding in a state in which the first coupling member 70 and the pin 75 are held between the drive-side drum flange 63 and the restricting member 76, as described above.

The first coupling member 70 engages with the first engaging portion 14 (FIG. 8) to receive a rotational force. The pin 75 receives the rotational force from the transmitting portion 70*d* of the first coupling member 70 and transmits the rotational force to the drive-side drum flange 63. The drive-side drum flange 63 receives a rotational force from the pin 75 and transmits the rotational force to the drum 62.

In this embodiment, the drive-side drum flange 63 is made of resin, such as polyacetal or polycarbonate, by injection molding. Alternatively, depending on the load torque for rotating the drum 62, the drive-side drum flange 63 may be made of metal.

Drive-Side Drum Flange

Figure 1A:
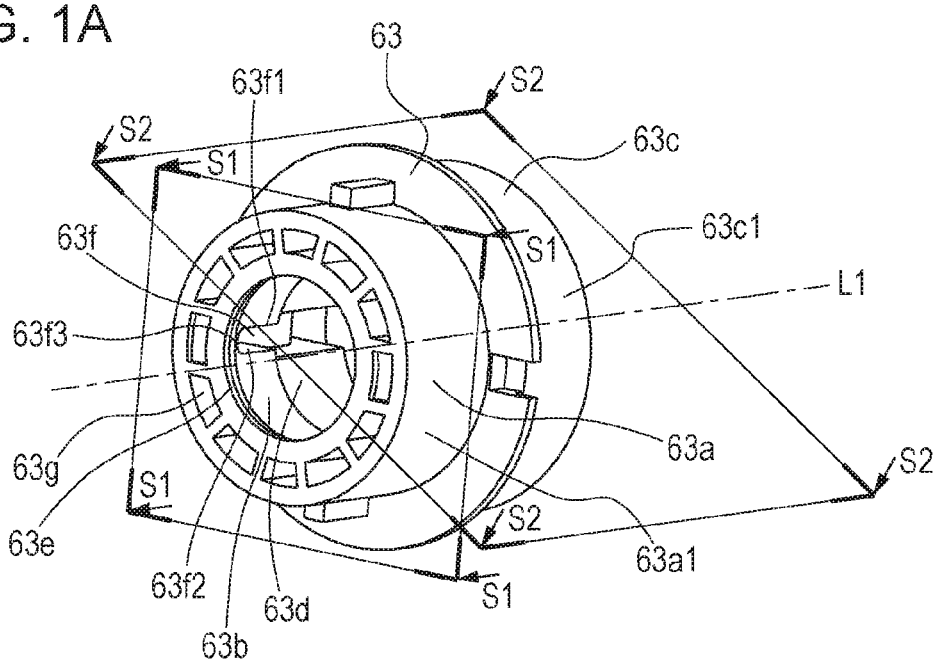
FIG. 1A is a perspective view of a drive-side drum flange according to an embodiment of the present disclosure.
Figure 1B:
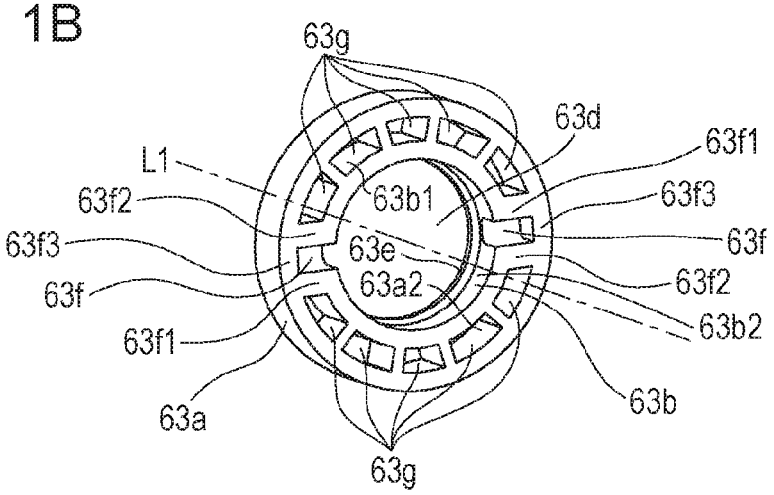
FIG. 1B is a perspective view of a portion of the drive-side drum flange taken along plane S1 in FIG. 1A.
Figure 1C:
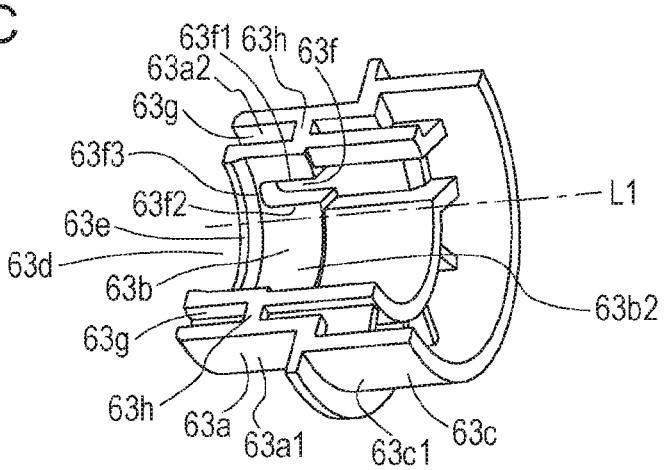
FIG. 1C is a perspective view of the drive-side drum flange taken along plane S2 in FIG. 1A.

Referring to FIGS. 1A to 1C, the drive-side drum flange 63 will be described. FIGS. 1A to 1C are diagrams illustrating the drive-side drum flange 63. Specifically, FIG. 1A is a perspective view of the drive-side drum flange 63 viewed from the drive side, FIG. 1B is a perspective view of a portion of the drive-side drum flange 63 taken along plane S1 in FIG. 1A, viewed from a non-drive side, and FIG. 1C is a perspective view of the drive-side drum flange 63 taken along plane S2 in FIG. 1A. The plane S1 is a plane perpendicular to the axis L1, and the plane S2 is a plane including the axis L1.

As described above, the drive-side drum flange 63 includes the first cylindrical portion 63*a*, the second cylindrical portion 63*b*, the third cylindrical portion 63*c*, the hollow 63*d*, the smallest-diameter portion 63*e*, and the recessed portions 63*f*. The first cylindrical portion 63*a* is rotatably supported by the bearing 73*a* of the drum bearing 73. The outside diameter of the second cylindrical portion 63*b* (the diameter of the outer circumferential surface 63*b*1) is smaller than the inside diameter of the first cylindrical portion 63*a* (the diameter of the inner circumferential surface 63*a*2). The second cylindrical portion 63*b* has a portion whose position in the direction of axis L1 is the same as the position of a portion of the first cylindrical portion 63*a* (an overlapping portion). The third cylindrical portion 63*c* is fit in the opening 62*a*1 (FIG. 14C) at an end of the drum 62 and joined to the drum 62 by bonding or swaging, as described above, and the outside diameter (the diameter of the outer circumferential surface 63*c*1) is larger than the outside diameter of the first cylindrical portion 63*a* (the diameter of the outer circumferential surface 63*a*1). A plurality of grooves 63*g* are provided between the inner circumferential surface 63*a*2 of the first cylindrical portion 63*a* and the outer circumferential surface 63*b*1 of the second cylindrical portion 63*b*.

Referring to FIG. 16C, a third wall 63*h* extending in the direction perpendicular to the axis L1 is provided between the first cylindrical portion 63*a* and the second cylindrical portion 63*b*. The third wall 63*h* is a substantially ring-shaped wall protruding from the outer circumferential surface 63*b*1 of the second cylindrical portion 63*b*. However, the third wall 63*h* is not provided at the recessed portions 63*f*. The third wall 63*h* extends in the radial direction with respect to the axis L1 from the outer circumferential surface 63*b*1 of the second cylindrical portion 63*b* toward the inner circumferential surface 63*a*2 of the first cylindrical portion 63*a* to connect the first cylindrical portion 63*a* and the second cylindrical portion 63*b* together. Next, the shape of the recessed portions 63*f* will be described. While the recessed portions 63*f* are provided at two symmetric positions about the axis L1, as described above, one of the recessed portions 63*f* will be described because their configurations are the same.

Of the recessed portion 63*f*, a portion subjected to a driving force that rotates the drum unit U1 is a first wall 63*f*1. A portion opposed to the first wall 63*f*1 is a second wall 63*f*2. The first wall 63*f*1 and the second wall 63*f*2 extend parallel to the axis L1. The pin 75 is disposed between the first wall 63*f*1 and the second wall 63*f*2. Of the recessed portion 63*f*, a portion connecting an end of the first wall 63*f*1 and an end of the second wall 63*f*2 in the direction of the axis L1 is a connecting portion 63*f*3. The first wall 63*f*1, the second wall 63*f*2, and the connecting portion 63*f*3 are disposed at the same positions in the direction of axis L1 as the positions of the first cylindrical portion 63*a* and the second cylindrical portion 63*b* (overlapping positions) to individually connect to the first cylindrical portion 63*a* and the second cylindrical portion 63*b* together. The connecting portion 63*f*3 is disposed adjacent to the smallest-diameter portion 63*e* side in the direction of axis L1 with respect to the recessed portions 63*f* (the inward protrusion side). The connecting portion 63*f*3 is disposed adjacent to the smallest-diameter portion 63*e* in the direction of axis L1 with respect to the pin 75.

Thus, the first wall 63*f*1 subjected to the driving force from the pin 75 connects the first cylindrical portion 63*a* and the second cylindrical portion 63*b* connected by the second wall 63*f*2 and the connecting portion 63*f*3, so that it has high rigidity. Furthermore, the connecting portion 63*f*3 connects an end of the first wall 63*f*1 and an end of the second wall 63*f*2 in the direction of axis L1 to thereby reinforce the first wall 63*f*1. This prevents the drive-side drum flange 63 from being deformed by the driving force that the first wall 63*f*1 undergoes. This also reduces fluctuations in the rotational speed of the drum unit U1. This improves the quality of imaged formed by the electrophotographic image forming apparatus.

The recessed portions 63*f* overlap in position in the direction of axis L1 with the first cylindrical portion 63*a*. This allows the drive-side drum flange 63 moved in the radial direction when the recessed portions 63*f* are subjected to the driving force to be received with the bearing 73*a* that supports the first cylindrical portion 63*a*, reducing losses of the force.

Furthermore, the recessed portions 63*f* overlap in position in the direction of axis L1 with the grooves 63*g*. This prevents the wall of the recessed portions 63*f* from increasing in width, improving the dimensional accuracy of the recessed portions 63*f*, the first cylindrical portion 63*a*, and the second cylindrical portion 63*b*.

The functions, materials, shapes, and relative positions of the components described in this embodiment are not intended to limit the scope of the present disclosure unless otherwise specified.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-203145, filed Oct. 14, 2015, which is hereby incorporated by reference herein in its entirety.

What is claimed is:

1. An electrophotographic photosensitive drum unit comprising:

an electrophotographic photosensitive drum;

a coupling member configured to be rotated by a driving force;

a shaft member configured to be rotated by the driving force transmitted from the coupling member; and a flange member secured to the electrophotographic photosensitive drum, the flange member being configured to be rotated by the driving force transmitted from the shaft member, wherein the flange member comprises:

a first cylindrical portion including a first outer circumferential surface and a first inner circumferential surface;

a second cylindrical portion disposed inside the first cylindrical portion in such a manner that a central axis of the second cylindrical portion is coaxial with the first cylindrical portion including a second outer circumference surface and a second inner circumferential surface, wherein the coaxial central axis defines a central axis direction;

an inwardly protruding portion protruding from an inner circumference of the second cylindrical portion and restricting a position of the coupling member in a central axis direction of the first cylindrical portion;

a first wall extending in the central axis direction and connecting the first cylindrical portion and the second cylindrical portion together, the first wall being in contact with the shaft member to receive the driving force;

a second wall extending in the central axis and connecting the first cylindrical portion and the second cylindrical portion together, the second wall being opposed to the first wall; and a connecting portion connecting the first cylindrical portion and the second cylindrical portion together and connecting the first wall and the second wall together, wherein a groove is provided inside the first inner circumferential surface and outside the second outer circumferential surface, wherein a recessed portion recessed outwards from an inner circumferential surface of the second cylindrical portion is formed by the first wall, the second wall, and the connecting portion, wherein the coupling member is held in the second cylindrical portion so as to be capable of tilting, wherein the shaft member is disposed between the first wall and the second wall, and wherein the connecting portion is disposed between the inwardly protruding portion and the shaft member in the central axis direction.

2. The electrophotographic photosensitive drum unit according to claim 1, wherein the flange member further comprises a third cylindrical portion secured to the electrophotographic photosensitive drum and disposed such that a central axis is coaxial with the first cylindrical portion, the third cylindrical portion being larger in outside diameter than the first cylindrical portion.

3. The electrophotographic photosensitive drum unit according to claim 1, wherein the flange member is formed by injection molding.

4. The electrophotographic photosensitive drum unit according to claim 1, wherein the flange member further comprises a third wall extending in a radial direction with respect to the central axis to connect the first cylindrical portion and the second cylindrical portion together.

5. The electrophotographic photosensitive drum unit according to claim 1, further comprising a restricting member opposed to the inwardly protruding portion, in the central axis direction, with the coupling member in between, the restricting member restricting a position of the coupling member in the central axis direction of the first cylindrical portion.

6. A cartridge detachably mounted in an image forming apparatus main body, the cartridge comprising:

an electrophotographic photosensitive drum unit comprising an electrophotographic photosensitive drum; a coupling member configured to be rotated by a driving force;

a shaft member configured to be rotated by the driving force transmitted from the coupling member; and a flange member secured to the electrophotographic photosensitive drum, the flange member being configured to be rotated by the driving force transmitted from the shaft member; and a drum supporting member rotatably supporting the electrophotographic photosensitive drum unit, wherein the flange member comprises:

a first cylindrical portion rotatably supported by the drum supporting member and including a first outer circumferential surface and a first inner circumferential surface;

a second cylindrical portion disposed inside the first cylindrical portion in such a manner that a central axis of the second cylindrical portion is coaxial with the first cylindrical portion and including a second outer circumferential surface and a second inner circumferential surface, wherein the coaxial central axis defines a central axis direction;

an inwardly protruding portion protruding inwards from an inner circumference of the second cylindrical portion and restricting a position of the coupling member in a central axis direction of the first cylindrical portion;

a first wall extending in the central axis direction and connecting the first cylindrical portion and the second cylindrical portion together, the first wall being in contact with the shaft member to receive the driving force;

a second wall extending in the central axis direction and connecting the first cylindrical portion and the second cylindrical portion together, the second wall being opposed to the first wall; and a connecting portion connecting the first cylindrical portion and the second cylindrical portion together and connecting the first wall and the second wall together, wherein a groove is provided inside the first inner circumferential surface and outside the second outer circumferential surface, wherein a recessed portion recessed outwards from an inner circumferential surface of the second cylindrical portion is formed by the first wall, the second wall, and the connecting portion, wherein the coupling member is held in the second cylindrical portion so as to be capable of tilting, wherein the shaft member is disposed between the first wall and the second wall, and wherein the connecting portion is disposed between the inwardly protruding portion and the shaft member in the central axis direction.

7. The cartridge according to claim 6, wherein the flange member further comprises a third cylindrical portion secured to the electrophotographic photosensitive drum and disposed such that a central axis is coaxial with the first cylindrical portion, the third cylindrical portion being larger in outside diameter than the first cylindrical portion.

8. The cartridge according to claim 6, wherein the flange member is formed by injection molding.

9. The cartridge according to claim 6, wherein the flange member further comprises a third wall extending in a radial direction with respect to the central axis to connect the first cylindrical portion and the second cylindrical portion together.

10. The cartridge according to claim 6, further comprising a restricting member opposed to the inwardly protruding portion, in the central axis direction, with the coupling member in between, the restricting member restricting a position of the coupling member in the central axis direction of the first cylindrical portion.

11. The cartridge according to claim 6, further comprising a processing unit for the electrophotographic photosensitive drum.

12. A flange member configured to rotate by receiving a driving force, the flange member comprising:

a first cylindrical portion including a first outer circumferential surface and a first inner circumferential surface;

a second cylindrical portion disposed inside the first cylindrical portion in such a manner that a central axis of the second cylindrical portion is coaxial with the first cylindrical portion and including a second outer circumferential surface and a second inner circumferential surface, wherein the coaxial central axis defines a central axis direction;

an inwardly protruding portion protruding inwards from an inner circumference of the second cylindrical portion;

a first wall extending in the central axis direction and connecting the first cylindrical portion and the second cylindrical portion together, the first wall being in contact with a driving force transmitting member to receive the driving force;

a second wall extending in the central axis direction and connecting the first cylindrical portion and the second cylindrical portion together, the second wall being opposed to the first wall; and a connecting portion connecting the first cylindrical portion and the second cylindrical portion together and connecting the first wall and the second wall together, wherein a groove is provided inside the first inner circumferential surface and outside the second outer circumferential surface, wherein a hollow is provided inside the second cylindrical portion, wherein a recessed portion recessed outwards from an inner circumferential surface of the second cylindrical portion is formed by the first wall, the second wall, and the connecting portion, and wherein the connecting portion is disposed between the inwardly protruding portion and the recessed portion in the central axis direction.

13. The flange member according to claim 12, further comprising a third cylindrical portion disposed such that a central axis is coaxial with the first cylindrical portion and having at least a portion disposed at a different position from the first cylindrical portion in the central axis direction, the third cylindrical portion being larger in outside diameter than the first cylindrical portion.

14. The flange member according to claim 12, wherein the flange member is formed by injection molding.

15. The flange member according to claim 12, further comprising a third wall extending in a radial direction with respect to the central axis to connect the first cylindrical portion and the second cylindrical portion together.

16. A coupling unit comprising:

a coupling member configured to be rotated by a driving force;

a shaft member configured to be rotated by the driving force transmitted from the coupling member; and a flange member configured to be rotated by the driving force transmitted from the shaft member, wherein the flange member comprises:

a first cylindrical portion including a first outer circumferential surface and a first inner circumferential surface;

a second cylindrical portion disposed inside the first cylindrical portion in such a manner that a central axis of the second cylindrical portion is coaxial with the first cylindrical portion and including a second outer circumferential surface and a second inner circumferential surface, wherein the coaxial central axis defines a central axis direction;

an inwardly protruding portion protruding from an inner circumference of the second cylindrical portion and restricting a position of the coupling member in a central axis direction of the first cylindrical portion;

a first wall extending in the central axis direction and connecting the first cylindrical portion and the second cylindrical portion together, the first wall being in contact with the shaft member to receive the driving force;

a second wall extending in the central axis direction and connecting the first cylindrical portion and the second cylindrical portion together, the second wall being opposed to the first wall; and a connecting portion connecting the first cylindrical portion and the second cylindrical portion together and connecting the first wall and the second wall together, wherein a groove is provided inside the first inner circumferential surface and outside the second outer circumferential surface, wherein a recessed portion recessed outwards from an inner circumferential surface of the second cylindrical portion is formed by the first wall, the second wall, and the connecting portion, wherein the coupling member is held in the second cylindrical portion so as to be capable of tilting, wherein the shaft member is disposed between the first wall and the second wall, and wherein the connecting portion is disposed between the inwardly protruding portion and the shaft member in the central axis direction.

17. The coupling unit according to claim 16, wherein the flange member further comprises a third cylindrical portion disposed such that a central axis is coaxial with the first cylindrical portion, the third cylindrical portion being larger in outside diameter than the first cylindrical portion.

18. The coupling unit according to claim 16, wherein the flange member is formed by injection molding.

19. The coupling unit according to claim 16, wherein the flange member further comprises a third wall extending in a radial direction with respect to the central axis to connect the first cylindrical portion and the second cylindrical portion together.

20. The coupling unit according to claim 16, further comprising a restricting member opposed to the inwardly protruding portion, in the central axis direction, with the coupling member in between, the restricting member restricting a position of the coupling member in the central axis direction of the first cylindrical portion.

* * * * *